United States Patent [19]

Josefsson

[11] Patent Number: 4,576,655

[45] Date of Patent: Mar. 18, 1986

[54] METHOD FOR PRODUCING HIGH STRENGTH STEEL WITH GOOD DUCTILITY

[75] Inventor: Erik A. A. Josefsson, Borlänge, Sweden

[73] Assignee: SSAB Svenskt Stal AB, Stockholm, Sweden

[21] Appl. No.: 769,807

[22] Filed: Aug. 27, 1985

Related U.S. Application Data

[63] Continuation of Ser. No. 621,457, Jun. 18, 1984, abandoned.

[30] Foreign Application Priority Data

Jun. 23, 1983 [SE] Sweden ..... 8303606

[51] Int. Cl.[4] ..... C21D 7/14

[52] U.S. Cl. ..... 148/12 F

[58] Field of Search ..... 148/12 F, 12.4

[56] References Cited

U.S. PATENT DOCUMENTS

| | | | |
|---|---|---|---|
| 3,826,691 | 7/1974 | Melloy et al. | 148/12 F |
| 3,849,206 | 11/1974 | Ishizaki et al. | 148/12 F |
| 4,115,155 | 9/1978 | Roe | 148/12 F |
| 4,395,296 | 7/1983 | Abrams | 148/12.4 |
| 4,406,711 | 9/1983 | Nagumo et al. | 148/12 R |

OTHER PUBLICATIONS

Tanaka et al., "Three Stages of the Controlled-Rolling Process", Micro Alloying 75, Session 1, Conference in Wash., D.C., Oct. 1-3, 1975, pp. 88-99.

Heedman et al., "Controlled Rolling of Plates with Forced Water Cooling During Rolling", Metals Technology, Sep. 1981, pp. 352-360.

*Primary Examiner*—Wayland Stallard

*Attorney, Agent, or Firm*—Watson, Cole, Grindle & Watson

[57] ABSTRACT

The present invention provides a method for producing hot rolled steel products having high strength and ductility. The method is particularly suitable for low alloy structural steels which contain about 0.02 to 0.15 wt. % C and 0.100 to about 0.015% Nb, the higher Nb percentage being used for steels with the lower C content and vice versa. In the method, the steel is heated to a temperature of about 1150° to about 1250° C. The steel is then rolled during a first sequence of passes so that the average austenite grain size at the end of the first sequence stays below about 50 um and so that the last pass in this sequence is conducted within the temperature range of about 950° to 1100° C. In a second rolling sequence directly following the first sequence, the rolling is continued with further reductions that do not exceed about 15% in each pass. Subsequently, the steel may be cooled to ambient temperature in a conventional manner.

5 Claims, 1 Drawing Figure

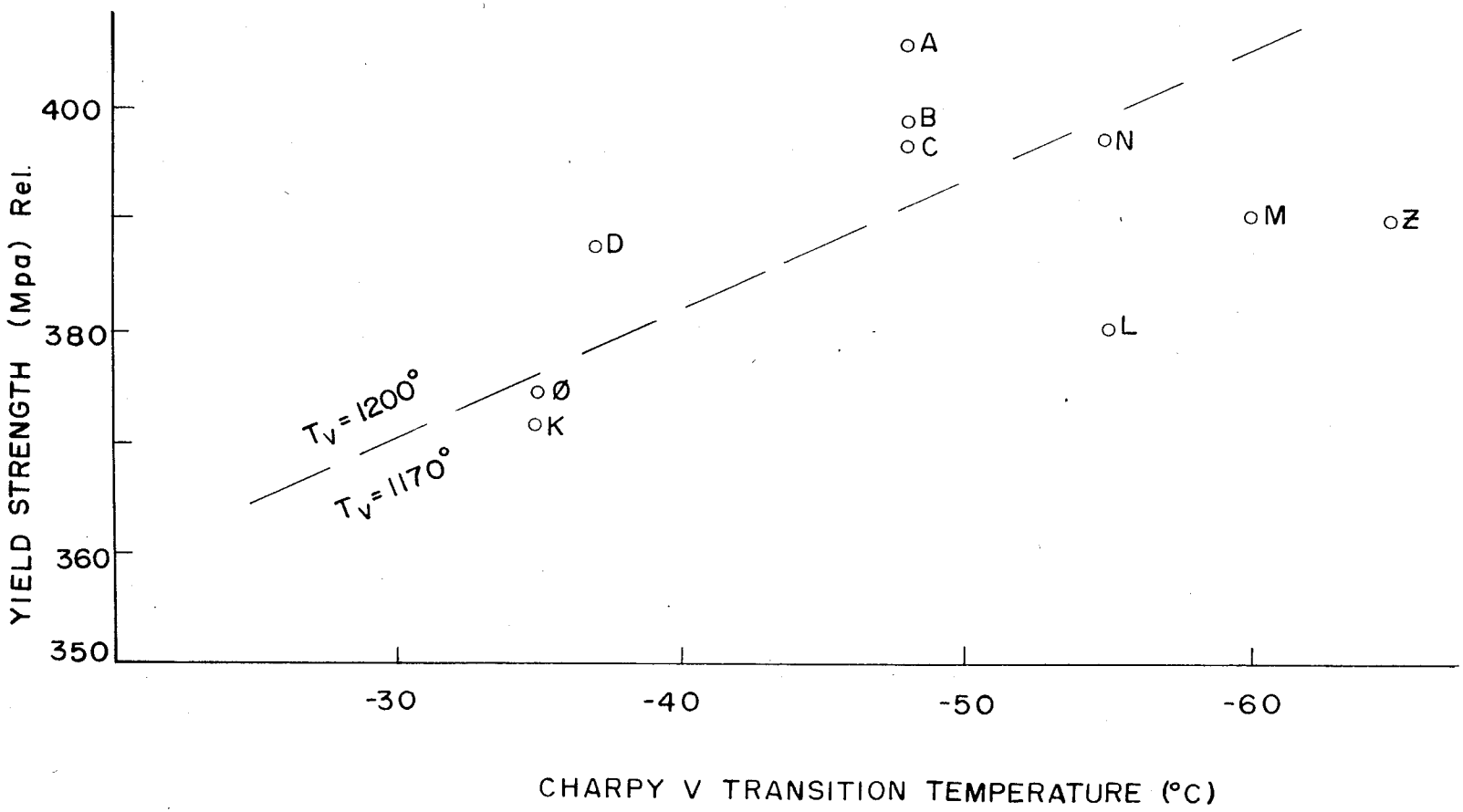
YIELD STRENGTH (Mpa) Rel.
400
380
360
350
-30
-40
-50
-60
CHARPY V TRANSITION TEMPERATURE (°C)
A
B
C
N
M
Z
L
D
Ø
K
$T_V = 120°$
$T_V = 117°$

METHOD FOR PRODUCING HIGH STRENGTH STEEL WITH GOOD DUCTILITY

This application is a continuation, of application Ser. No. 621,457, filed June 18, 1984, now abandoned.

The present invention relates generally to a method for fabricating structural steel which has high strength and good ductility.

In the conventional fabrication of structural steel such that the steel has both high strength and good ductility (low transition temperature), small additions of the so-called grain refining element (Nb, V, Ti, B) have been used to a great extent along with a method of hot rolling the steel where the reductions in the individual passes as well as the deformation temperatures are regulated with respect to the structure desired. This method is often termed controlled rolling. The objective of the controlled rolling method is that when the rolling is completed, either a fine-grained recrystallized austenite or a heavy deformed unrecrystallized austenite structure has been produced in the steel.

The former structure is obtained by making the finishing rolling passes with a high degree of reduction, the latter structure by effecting the finishing rolling passes at a low temperature, i.e., at a temperature lower than about 900° C. It is the fine grain of the recrystallized austenite, and in the alternative, the high degree of reduction of the nonrecrystallized austenite that provide the basis for forming a fine-grained polygonal ferrite during the subsequent cooling, and thus a basis for the combination of the high strength and good ductility characteristics of the finished steel.

To obtain a fine grained ferrite after the first alternative of controlled rolling where a fine grained recrystallized austenite is produced after the last pass, it is necessary that not only that the steel contains a suitable amount of grain-refining elements, e.g., Nb, but, also that at least in this last pass, reduction is relatively high, i.e., with an area reduction of 30% or more, as the recrystallized grain size of the austenite which is within the range of interest here, uniformly decreases with increasing reduction. On the other hand, in the last stage of the rolling, it is advisable to avoid reductions about and below about 20% as at this point, according to known laws for recrystallization, as there is a risk of producing enlarged recrystallized grains when approaching the so-called critical draft (degree of reduction). At even lower reductions, grain-coarsening has appeared even in grain without recrystallization by the so-called strain induced grain growth. With several such light passes, there also appears a risk for partial recrystallization and the known phenomenon of non-uniform grain size, which means a large loss of ductility and strength for the steel.

The other method mentioned above, where the rolling is conducted such that recrystallization does not occur, requires that, after a certain degree of roughening, the material must be cooled to a temperature below about 900° C., normally below about 850° C., before the finish rolling begins which causes retained deformation of the austenite. This method is often characterized as a thermomechanical treatment.

Both methods set forth above have inherent disadvantages with respect to the technical portion of the rolling procedure. High reductions during the finishing pass according to the first method require high roll forces which means that the capacity of the rolling mill can be a limiting factor. In addition, it is more difficult to maintain narrow thickness tolerances with high reductions. Another aggravating circumstance is that, to obtain good results in the form of fine grain in the final structure, the finishing temperature must be kept fairly low, as in other conditions being equal, the recrystallized grain size becomes finer, the lower the deformation temperature, and a low rolling temperature also contributes to an increase in the roll load. Conducting the rolling within the temperature range for non-recrystallization also results in extra loads in the rolling mill and is also an impediment for material flow since the material has to cool between roughening and the finish rolling, which increases the fabrication time and also decreases rolling capacity. In this latter case, the deformation may be performed as a series of light passes, provided that they are repeated in such a number that the total reduction is high enough, usually a minimum of 50%. A high number of passes is needed, which is of course detrimental since it increases the costs associated with this method of rolling.

In accordance with the method of the present invention, it has now been shown, however, that, even with small finishing reductions under certain circumstances, it is possible to obtain steel with equal or better properties as compared with a high finishing reduction and this method can be accomplished without delaying the rolling by utilizing the low finishing temperatures which are required in the second rolling sequence as described above. The finish rolling can, on the contrary, be conducted directly after roughening in the temperature range of about 900° to 1100° C. and with low reductions, i.e., below about 15%.

Thus, the present invention provides a method for producing hot rolled steel products having high strength and ductility. The method is particulalarly suitable for low alloy structural steels which contain about 0.02 to 0.15 wt. % C and 0.100 to about 0.015% Nb, the higher Nb percentage being used for steels with the lower C content and vice versa. In the method, the steel is heated to a temperature of about 1150° to about 1250° C. The steel is then rolled during a first sequence of passes so that the average austenite grain size at the end of the first sequence stays below about 50 um and so that the last pass in this sequence is conducted within the temperature range of about 950° to 1100° C. In a second rolling sequence directly following the first sequence, the rolling is continued with further reductions that do not exceed about 15% in each pass. Subsequently, the steel may be cooled to ambient temperature in a conventional manner.

The method of the invention is explained in further detail in the following with reference to the drawing in which the sole figure is graphical representation of the mechanical properties of various steels, some of the steels having been produced by the method of the invention and others by methods outside the scope of the invention.

More particularly, in the method of the invention, the steel should contain a certain amount of Nb, e.g., about 0.015 to about 0.100%, the lower amount applicable to higher carbon contents, e.g., about 0.15% C and the higher amount applicable to a carbon content of about 0.05% and lower. Generally, the steels particularly suitable for the method contain minor amounts, e.g., less than about 2%, of one or more of Si, Mn, Cr, Mo and Ti.

In the present invention, the rolling of the steel is divided into two sequences. The first sequence is conducted such that the steel has a uniform, relatively fine grained recrystallized austenite (average less than 50 um measured on a sample section which has been cut out and water quenched) at the end of the sequence. To achieve this structure, at least in the last pass in this first sequence, the area reduction oftentimes is about 25%, preferably over about 30%. The second rolling sequence includes one or more light passes, each pass producing less than about 15% in area reduction. This second sequence can immediately follow the first sequence without any time waiting for the steel to cool if the temperature of the heat at the end of the first sequence is below about 110° C., and for lower amounts of Nb, below about 107° C.

To achieve the desired uniform, relatively fine grained austenite at the end of the first rolling sequence, it has been found to be advantageous to include Ti in amounts between about 0.005 and about 0.04%. With a suitable combination of heating temperature, reduction sequences and Nb content, it may, however, be possible to fill the same conditions even without the inclusion of Ti.

Furthermore, when particularly good ductility in the steel is required, it has proven important that at least one of the light finishing passes be conducted at a sufficiently high temperature (generally over about 950° C.) so that the precipitation of NbC from the austenite is favored as much as possible. Since the austenite obtained by the procedure of light finishing passes tends to transform to ferrite more readily as compared with the same austenite rolled by conventional methods, the procedure of the invention is well adapted to be combined with accelerated cooling by water spraying and the like as an extra strength increasing step.

The steel produced by the method of the invention is compared to steel produced by methods outside the scope of the invention in the following example.

EXAMPLE

A number of steel blooms with the approximate analysis of 0.09% C, 0.33% Si, 1.41% Mn, 0.013% P, 0.011% S, 0.010N, 0.027% Al, 0.007% Ti and 0.027% Nb were heated to about 1200° C. and hot rolled from a thickness of about 120 mm to a thickness of about 20 mm as per the different pass schedules set forth in the following table. When passing from the first rolling sequence with high degrees of reduction to second rolling sequence with light passes, the temperature of the plate bar was determined and sample sections were cut and cooled in water. In each of the sample sections, the austenite grain size existing before the cooling was determined. After the finish rolling of the second sequence, the plates were allowed to cool in air. The mechanical properties of the plates were determined from test bars that were cut normal to the rolling direction. The test results are set forth in the upper portion of the Table.

In another rolling series, blooms from the same heat as in earlier series were heated to about 1170° C. Hot rolling was performed and, as was done previously, the reductions for the particular passes were varied. The test results from this series are set forth in the lower portion of the Table. For greater clarity, the most important property values, i.e., the yield point and the transition temperature, are graphically presented in the drawing.

TABLE

Rolling Data and Results from Mechanical Testing

| Plate Code | Heating Temp. $T_V$ °C. | Reduction Schedule - Thickness red'n./pass: First Rolling Sequence % | 2nd Rol. Seq. % | Prior to 2nd sequence: Temp. °C. | Grain Size dγ um | Mechanical Properties: Yield Strength ReL MPa | Tensile Strength $R_m$ MPa | Elongation $A_5$ % | Transition Temp. $vT_{28}$ °C. | Remarks |
|---|---|---|---|---|---|---|---|---|---|---|
| A | 1200 | 17-25-25-36 | 10-10-10 | 970 | 40 | 405 | 521 | 31 | −48 | acc. to invention |
| B | " | 8-17-25-25-25-36 | 10-10 | " | 40 | 398 | 520 | 32 | −48 | " |
| C | " | 8-25-25-26-26-35 | 10 | " | 40 | 396 | 522 | 33 | −48 | " |
| D | " | 8-25-25-26-33 | 35 | " | 40 | 387 | 520 | 30 | −37 | outside invention |
| L | 1170 | 23-22-24-24-24 | 35 | 1082 | 45 | 379 | 517 | 29 | −55 | outside invention |
| M | " | 25-24-25-25-36 | 10-10 | 1079 | 35 | 389 | 520 | 31 | −60 | acc. to invention |
| N | " | 23-24-24-25-35 | 11.5-13 | 1070 | 35 | 396 | 519 | 28 | −55 | " |
| Z | " | 25-28-28-36 | 7-7-8-8-9 | 1085 | 35 | 389 | 517 | 32 | −65 | " |
| O | " | 21-23-23-23-35 | 14-17 | 1080 | 35 | 368 | 518 | 29 | −35 | outside invention |
| K | " | 8-25-25-26-33 | 35 | 1080 | 40 | 374 | 516 | 31 | −35 | " |

From the results set forth in the Table and the Drawing, it can be noted that the plates with low reductions in the second rolling sequence show a better combination of yield point and transition temperature characteristics than the plates produced with high reductions, such as 35% in the finishing pass. It should also be noted that with a reduction of 17% in the finishing pass (plate O), a lower ductility is obtained than in the plates where finishing reductions are limited to below about 15%. A lower ductility is also obtained after the normal rolling with high finishing reduction of 35% (plates D and K).

To the extent not indicated, all percentages set forth above are by weight.

It is claimed:

1. A process for manufacturing hot rolled steel products having a high strength and good ductility as hot rolled, said method comprising (a) producing a low-alloy steel having a carbon content within the range of about 0.02 to 0.15 wt %, a niobium content within the range of about 0.015 to 0.100 wt %, and a titanium content within the range of about 0.005 to 0.040 wt %, (b) heating said low-alloy steel of step (a) to a temperature between about 1150° and 1250° C., (c) subjecting said low-alloy steel produced in step (b) to a first rolling sequence which includes at least one rolling pass, one rolling pass of said first rolling sequence being a final rolling pass, such that said low-alloy steel has a an average austenite grain size therein of less than 50 μm and such that said low-alloy steel, after said final rolling pas, has a temperature of between about 950° and 1100° C., (d) subjecting said low-alloy steel produced in step (c) to a second rolling sequence which includes at least one rolling pass, each said rolling pass in said second rolling sequence being conducted at a temperature between about 900° and 1100° C. and one of said rolling passes being conducted at a temperature between about 950° C. and 1100° C., each said rolling pass producing an area reduction in said low-alloy steel of less than 15%, the total area reduction of said low-alloy steel in said second rolling sequence being less than about 39%, and (e) cooling the low-alloy steel produced in step (d).

2. A process according to claim 1, wherein the area reduction of the low-alloy steel in the final rolling pass of the first rolling sequence of step (c) exceeds about 25%.

3. A process according to claim 1, wherein the area reduction of the low-alloy steel in the final rolling pass of the first rolling sequence of step (c) exceeds about 30%.

4. A process according to claim 1, wherein in step (e) the low-alloy steel is sprayed with water.

5. A process according to claim 1, wherein the low-alloy steel provided in step (a) includes up to about 2 wt % of one or more additive elements selected from the group consisting of silicon, manganese, chromium and molybdenum.

* * * * *